United States Patent [19]

Soucy

[11] 4,321,763

[45] Mar. 30, 1982

[54] MAGNETIC CALENDAR HOLDER

[76] Inventor: Norman F. Soucy, 91 Garfield Ave., Lynn, Mass. 01905

[21] Appl. No.: 191,496

[22] Filed: Sep. 29, 1980

[51] Int. Cl.[3] ..... G09D 3/10

[52] U.S. Cl. ..... 40/120; 40/358; 40/109; 40/490

[58] Field of Search ..... 40/109, 107, 358, 120, 40/489, 490, 491

[56] References Cited

U.S. PATENT DOCUMENTS

| | | | |
|---|---|---|---|
| 466,704 | 1/1892 | Reily | 40/120 X |
| 3,579,882 | 5/1971 | Miyahune | 40/107 |
| 3,670,436 | 6/1972 | Weissman | 40/107 |
| 3,683,532 | 8/1972 | Ankrum | 40/358 |
| 4,275,516 | 6/1981 | Lane | 40/120 |

*Primary Examiner*—Gene Mancene
*Assistant Examiner*—Wenceslao J. Contreras
*Attorney, Agent, or Firm*—Thompson, Birch, Gauthier & Samuels

[57] ABSTRACT

A calendar stand has a tray formed therein. A top surface has windows which register with the trays. A card displaying information passes through the slots and is placed on the trays and magnetically held thereon. The cards can only be removed by a special tool which passes through the slot. Additionally, a pen is provided which is secured to the stand which pen can only be opened with a special tool.

5 Claims, 3 Drawing Figures

60
66
68
70
64
62

80
134
122
124
133
132
118
114
116
108
112
102
106

100
80
44
42
10
18
20
12
34
40
30
38
28
36
26
14
16
24
22
20

FEB
TUES
46
48
50
52
51
50

MAGNETIC CALENDAR HOLDER

BACKGROUND AND BRIEF SUMMARY OF THE INVENTION

Desk or table calendars which display only an individual day/date, e.g. WEN Aug. 15, 1980, are commonly used in financial establishments and the like as an accomodation to customers. Typically, the day/date is displayed by rotation of drums which directly or through windows display the day/date or by insertion of cards, on which the day/date appears, in a holder. Additionally, pens are customarily provided for the convenience of the customers.

In many instances, the drums will be rotated by customers, or the cards removed and the pens removed or opened to release the pen filler. Thus, what originally was an attempt to enhance convenience to customers, has become a bother because of the possibility of incorrect day/dates being displayed and/or unavailability or non-useability of a pen.

I have discovered a pen assembly and a calendar stand, the latter for displaying day/date information, either of which may be used alone or in combination, which overcome the aforementioned problems.

My invention in one aspect includes a pen assembly comprising a barrel in which is received a standard filler, a cap engaged to the barrel and a spacer interposed between the cap and the filler. The cap is securely engaged to the barrel and is characterized by a central aperture through which passes a cable, and two recesses on the upper surface of the cap. The recesses are adapted to be engaged by a mating tool which securely locks the cap and thus, the cable in place. The cap can only be removed by the tool. The other end of the cable is securely attached to either the calendar stand or to another structure.

My invention in another aspect comprises a calendar stand which is secured to a supporting surface. The stand comprises four sides and a top face having a transparent window. At least one of the sides, preferably the front side, includes a slot corresponding with a tray formed within the stand. The tray is in register with the window. The tray is defined by side walls and a rear wall. One of the walls, preferably the rear wall, has received therein magnetic material. A card displaying the appropriate day/date information slides through the slot and is received on the tray. The trailing edge of the card is recessed with reference to the front side of the stand. The card carrying the information has magnetic material on one of its sides which mates with the magnetic material of the tray thereby securing the card in position in the tray with the information being displayed through the window. The trailing edge of the card also includes a magnetic material which is adapted to mate with a special tool which is configured both to engage the card and to be received within the slot of the stand. When the card is to be removed, the tool magnetically engages the card and the card is removed through the slot.

DESCRIPTION OF THE PREFERRED EMBODIMENT

Figures 1, 2, 3, 4:
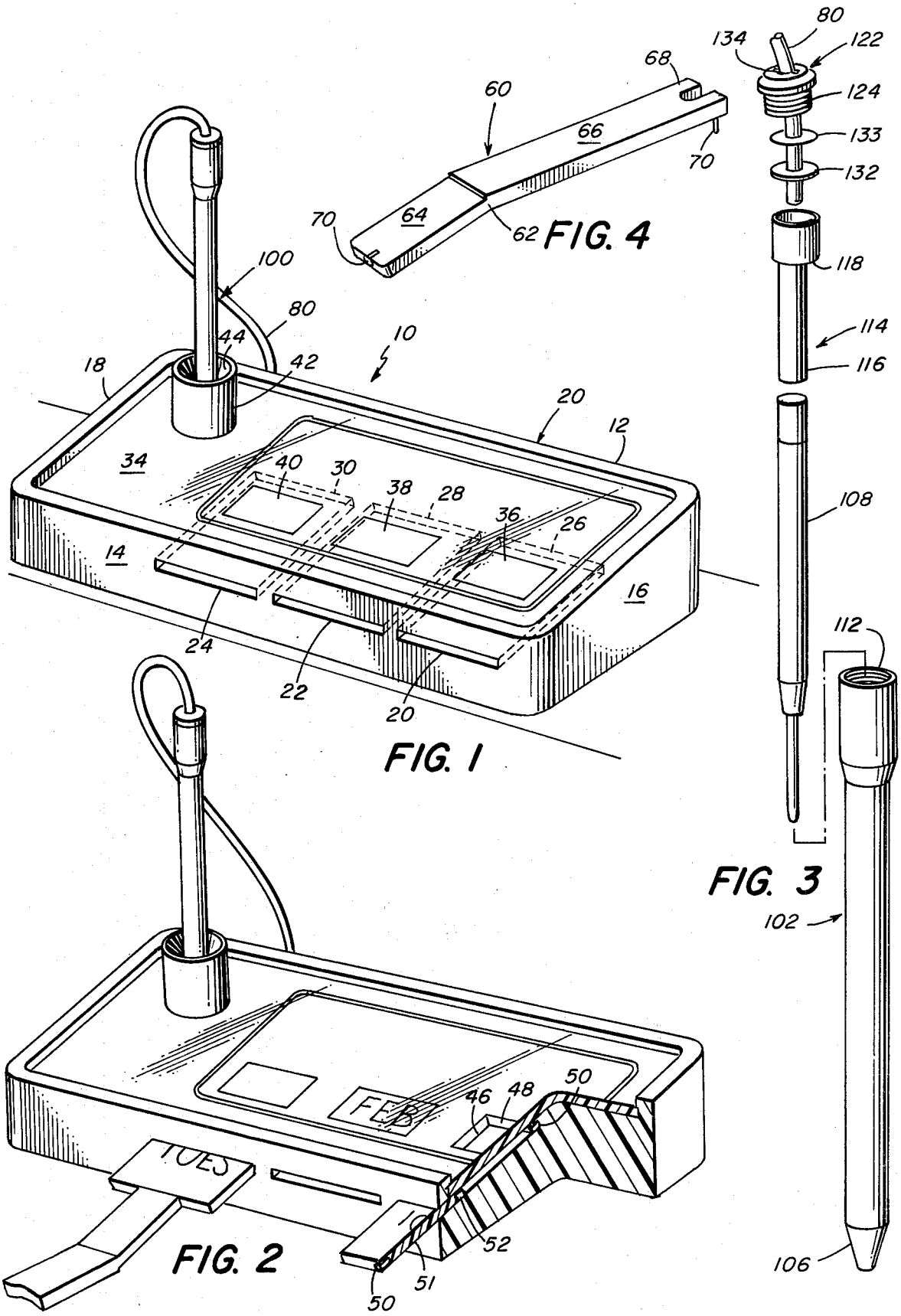
FIG. 1 is a perspective illustration of a calendar stand and pen of the preferred embodiment of the invention.
FIG. 2 is a perspective broken-away view of the stand of FIG. 1.
FIG. 3 is a perspective telescopic view of the pen shown in FIG. 1.
FIG. 4 is an illustration of the card removal tool.

Referring to FIG. 1, a calendar stand and pen assembly embodying the preferred invention is shown generally at 10 and comprises the stand 20 and the pen assembly 100 joined to the stand 20 by a cable 80.

The stand is secured at its base to a table or the like and comprises four walls, a higher rear wall 12, a lower front wall 14, and sides 16 and 18. Formed in the front wall are slots 20, 22, and 24. Each of the slots fronts trays 26, 28 and 30, shown in dotted lines in FIG. 1. A top surface 34 is secured to the upper ends of the walls and slopes forwardly and downwardly from the rear wall to the forward wall. The top includes transparent windows 36, 38 and 40, which register with the trays 26, 28 and 30.

Secured to the top surface 34 is a cylindrical receptacle 42 having an inner cone-shaped 44 which receives the pen assembly 100.

Referring to FIG. 2, the stand of FIG. 1 is shown. One of the trays will be described in detail, it being understood that the other two trays are identical in structure and function. The tray 26 includes opposed side walls 46 (only one shown) and a rear wall 48. The rear wall has received therein a magnetic pin 50.

A card 51 containing the information to be displayed for a particular day/date is inserted through the slot 20 and onto the tray 26. The card 51 comprises leading and trailing edges into which are received magnetic pins 52 and 54, respectively. The card is moved on the tray 26 by a tool 60 until such time that the magnetic pins 50 and 52 engage. At this point, the tool 60 is removed. The use of the tool 60 with a card is shown in FIG. 2 for the slot 24 and tray 30.

The tool 60 is a flat elongated member having a slight bend 62 forming sections 64 and 66. The end of section 68 has a magnetic pin 70 which engages the magnetic pin 54 at the trailing edge of the card 51. The width of the section 64 is less than the width of the side walls of the tray 26 and its associated slot 20. When the card 51 is inserted the pins 50 and 52 engage. The magnetic strength of these pins between the rear wall and edge of the card is less than the magnetic strength between the pin 70 at the end of the section 64 and the pin in the trailing edge of the card. After the pins 52-50 have engaged, the tool 60 is moved laterally disengaging the pins 70 and 54 and removed, while the pins 50 and 52 remain engaged. The side edges of the card 51 are dimensioned with reference to the side walls of the slot to prevent lateral movement or tilting of the card in the tray when the tool 60 is moved laterally to disengage the pins 70 and 54. The tool is then withdrawn through the slot 20.

To remove the card 51, the procedure is basically reversed; namely, the tool 60 is inserted, the pins 54 and 70 engage, and the tool is withdrawn along the axis passing through pins 50, 52, 54 and 70, thus disengaging the magnets 52 and 50. The tool 60 carries the card 51 with it through the slot 20.

Referring to FIG. 3, the pen assembly 100 is shown in telescopic perspective and comprises a barrel 102 having an upper end 104 and a lower end 106. A commercially available ball pen refill 108, such as a Parker Pen 79101, is received in the barrel 102 and extends through the lower end 106. The upper end of the barrel comprises an upwardly and outwardly sloping shoulder 110 joined to a sleeve 112 having an internally threaded surface.

A spacing element 114 comprises a lower elongated cylindrical portion 116, a shoulder 118 and sleeve 120. The spacer 114, when received in the barrel 102 engages the upper end of the refill 108 and the sleeve 120 is recessed below the upper edge of the sleeve 112. A cap 122 having a depending threaded wall 124 engages the sleeve 112. The cap 122 has an aperture in the center thereof through which passes the cable 80. The end of the cable is swaged and a washer 132 secures the end of the cable to the cap 122. A spring washer 133 is interposed between the cap 122 and the washer 132. The upper surface of the cap 122 includes two opposed recesses 134.

The section 66 of the tool 60 terminates with fingers 68 having projections 70 extending from the fingers. To secure or remove the cap 122 to or from the pen assembly 100, such as to change a filler, the projections 68 engage the recesses 134 in the cap 122, the fingers 66 spanning the cable 80. Rotation of the tool 60 threads the cap to the sleeve 120.

The outer surface of the cap 122 is dimensionally equal to the outer surface of the sleeve 112. With the use of the tool 60, the cap is securely tightened to the barrel and, as a practical matter, cannot be removed therefrom without the tool. The other end of the cable 80 is secured in a fixed manner to the stand 10.

Although my invention has been described in reference to a specific number of windows of a particular geometric configuration, a single window or a plurality of windows of different geometric configurations could be used. Also, the means to engage the card, to the tool and to the stand, in the preferred embodiment is a pin of magnetic material. Other types of magnetic material may also be used. Further, the magnetic pins or other magnetic materials, may be secured to the sides of the trays rather than the back wall. Other variations to my basic invention will be apparent to those skilled in the art and are within the scope of my invention.

Having described my invention, what I now claim is:

1. A device for displaying calendar information which comprises:

(a) a stand having at least one wall, the wall having at least one slot formed therein, and an outer surface joined to the wall, the surface having a transparent window;

(b) at least one tray formed within the stand, the slot fronting the tray and the surface of the tray in register with the transparent window, the tray including a rear wall and two side walls, one of said walls having magnetic material therein;

(c) a card having calendar information displayed thereon, the card dimensioned to slide through the slot and be received on the tray such that the information is displayed through the transparent window, the card including on one of its edges magnetic material, the magnetic material in the tray wall adapted to engage the magnetic material in the edge of the card when the card is inserted in the tray, the card further including magnetic material on another edge which edge is aligned with the slot; and, (d) means to magnetically remove the card from the tray.

2. The device of claim 1 wherein the magnetic material in the tray comprises a magnetic pin received in the rear wall of the tray, the card is generally rectangular in shape and has a leading edge which abuts the rear wall of the tray and a trailing edge aligned with the slot when the card is on the tray and further includes a magnetic pin received in its trailing edge and is dimensioned such that when received on the tray, the trailing edge is recessed with reference to the slot through which it passes and the sides of the card abut the side walls of the tray.

3. The device of claim 2 wherein the means to remove the card comprises a flat, elongated tool adapted to pass through the slot and be received within the tray, the tool including at one end a magnetic pin adapted to engage the pin of the trailing edge of the card, the magnetic strength between the magnetic pin of the trailing edge of the card and the pin of the tool being greater than the magnetic strength of the pin in the rear wall of the tray and the leading edge of the card whereby when the card is inserted, the tool may be moved laterally, disengaging the tool from the card while the pins of the rear wall and the leading edge of the card remain engaged holding the card in place and when the card is removed, the pin of the tool and the pin of the trailing edge are engaged and the card directly withdrawn through the slot.

4. The device of claims 1, 2 or 3 wherein the stand includes two side walls, a rear wall and a front wall, the front wall having a plurality of slots, and the stand further includes a plurality of trays formed therein aligned with the slots and the surface includes a plurality of transparent windows in register with each of the trays.

5. The device of claim 4 which includes means to receive a writing instrument therein.

* * * * *